US005860168A

United States Patent [19]

Winefordner et al.

[11] Patent Number: 5,860,168

[45] Date of Patent: Jan. 19, 1999

[54] DIVE MASK

[75] Inventors: Carl Winefordner; Frank Hermansen, both of Corona Del Mar, Calif.

[73] Assignee: Q.D.S. Injection Molding Inc., San Diego, Calif.

[21] Appl. No.: 876,166

[22] Filed: Jun. 13, 1997

[51] Int. Cl.[6] ..... A61F 9/02

[52] U.S. Cl. ..... 2/428; 128/200.29; 128/206.15

[58] Field of Search ..... 2/428, 429, 430, 2/426, 439; 128/200.29, 206.15, 207.12, 201.28

[56] References Cited

U.S. PATENT DOCUMENTS 5,329,643 7/1994 Sato ..... 2/428

5,345,615 9/1994 Garofalo ..... 2/430

5,564,130 10/1996 Feng ..... 2/428

FOREIGN PATENT DOCUMENTS 1189800 10/1959 France ..... 2/430

*Primary Examiner*—Peter Nerbun

*Attorney, Agent, or Firm*—Leonard Tachner

[57] ABSTRACT

A dive mask having a drain and deflector flow guide soft skirt. The flexible skirt has a built-in purge valve and a nose compression recess on each side of a nose enclosure. The skirt thus exhausts and deflects exhaled bubbles away from the diver's line of vision. The two recesses permit one-handed finger access to permit the diver to squeeze his or her nostrils together to permit the diver to equalize ear pressure with the water pressure.

6 Claims, 3 Drawing Sheets

DIVE MASK

BACKGROUND OF THE INVENTION

1. Field of the Invention

The present invention relates generally to the field of diving equipment and more particularly to a dive mask which employs a soft skirt to channel air bubbles away from the line of sight of the diver.

2. Prior Art

The concept of a dive mask having a configuration for channeling purged air bubbles away from the diver's line of sight, is not new. U.S. Pat. No. 4,856,120 to Dennis Hart discloses such a mask. While this prior art dive mask provides the advantage of preventing air bubbles from obscuring the diver's vision, it also presents a significant disadvantage. More specifically, the additional channeling structure of the aforementioned prior art mask, prevents external access to the diver's nose with the mask in place. During a typical dive, it is relatively common for the diver to create increased internal pressure in his or her nasal and ear passages to equalize and clear pressure-induced inner ear clogging which can otherwise become uncomfortable and even painful. To perform this simple maneuver, the diver must close his or her nostrils to allow pressure build-up. Without closure of the nostrils, any attempted pressure increase is thwarted by air escape through the nose. Closing the nostrils is preferably accomplished by the diver simply grasping his or her nose between the thumb and forefinger of one hand and squeezing to close his or her nasal passages for the few seconds it takes to build pressure to clear the ears. However, to accomplish this apparently simple task, there cannot be any hard, inflexible surfaces between the diver's nose and the diver's hand. Unfortunately the mask disclosed in U.S. Pat. No. 4,856,120 does, in fact, comprise a hard, inflexible surface immediately adjacent the diver's nose which prevents access in the mariner described especially when using a scuba regulator. As a result, to clear the ears while wearing this prior art mask, the diver must displace the mask sufficiently to gain direct access to his or her nose and then subsequently employ well-known techniques to rid the mask of water.

It therefore would be highly advantageous to provide a dive mask having a lower channel for steering air bubbles away from a diver's line of sight while still providing a structure which permits the diver to close his or her nostrils to momentarily build pressure in ear passages. It would be also highly desirable to provide an aesthetically pleasing purge and channeling structure which does not burden the appearance of the underlying mask with a bulky, unappealing mass or significantly increase the weight or profile of the mask.

SUMMARY OF THE INVENTION

The present invention comprises a dive mask having a drain and deflector flow guide soft skirt. The flexible skirt has a built-in purge valve and a nose compression recess on each side of a nose enclosure. The skirt thus exhausts and deflects exhaled bubbles away from the diver's line of vision. The two recesses permit one-handed finger access to permit the diver to squeeze his or her nostrils together to permit the diver to equalize ear pressure with the water pressure. Other features provided by the present invention include the following: Overall low internal volume; light weight; low cost fabrication; aesthetically pleasing; easy assembly; few components; and adapted to upgrade existing non-purge masks.

OBJECTS OF THE INVENTION

It is therefore a principal object of the invention to provide a purge/deflector dive mask having a soft skirt which includes an air bubble purge valve and a deflector channel for guiding air bubbles to the sides of the masks.

It is another object of the invention to provide a purge/deflector dive mask that is easy to assemble, uses few components, is lightweight and can be upgraded from non-purge mask components.

It is another object of the invention to provide a purge/deflector dive mask having a transparent silicone soft skirt comprising the purge valve and deflector channel and providing nose compression recesses on each side of a nose enclosure.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF PREFERRED EMBODIMENTS

Figure 1:
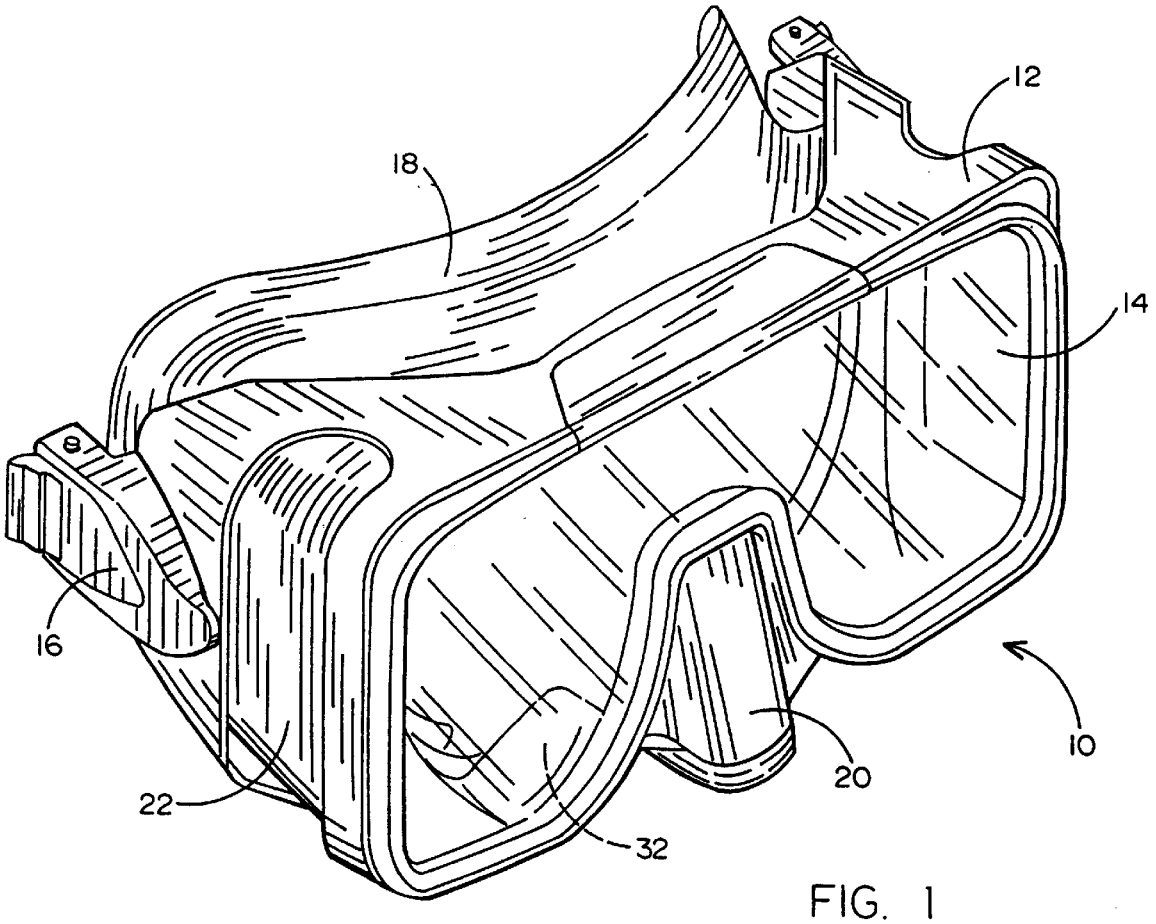
FIG. 1 is a three-dimensional view of a first embodiment of the invention.
Figure 2:
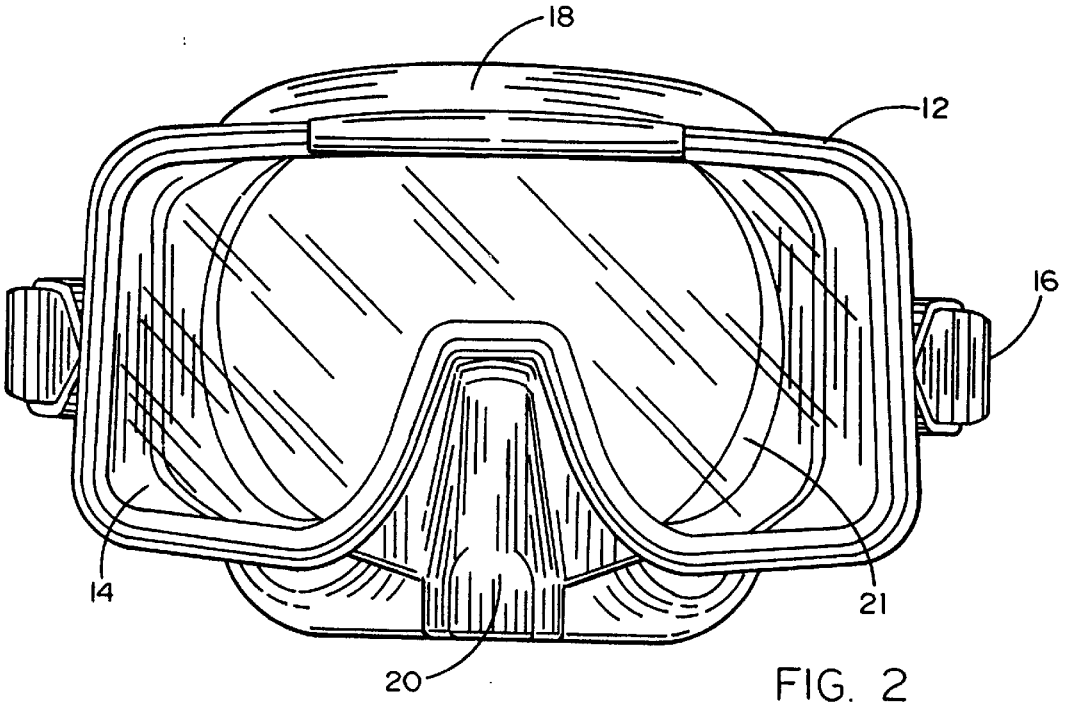
FIG. 2 is a front view of the first embodiment.
Figure 3:
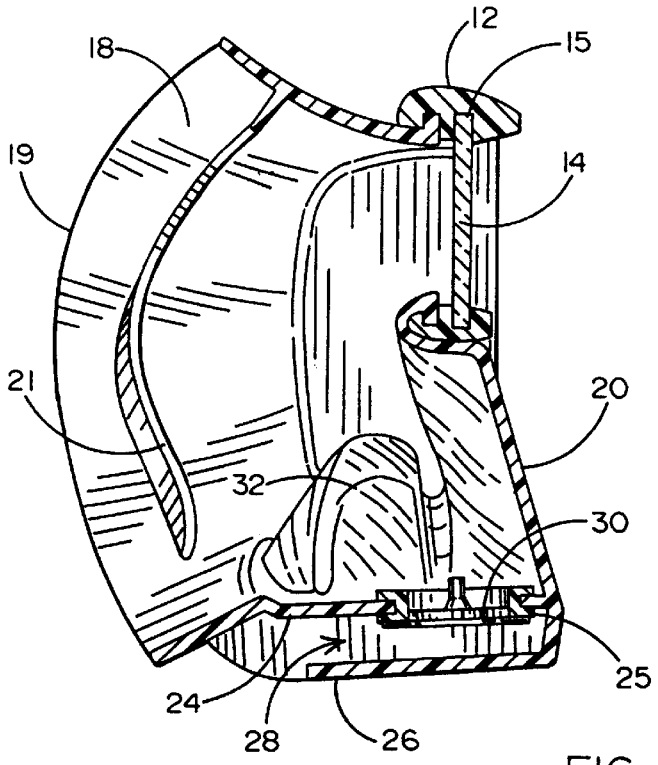
FIG. 3 is a cross-sectional side view of the first embodiment.
Figure 4:
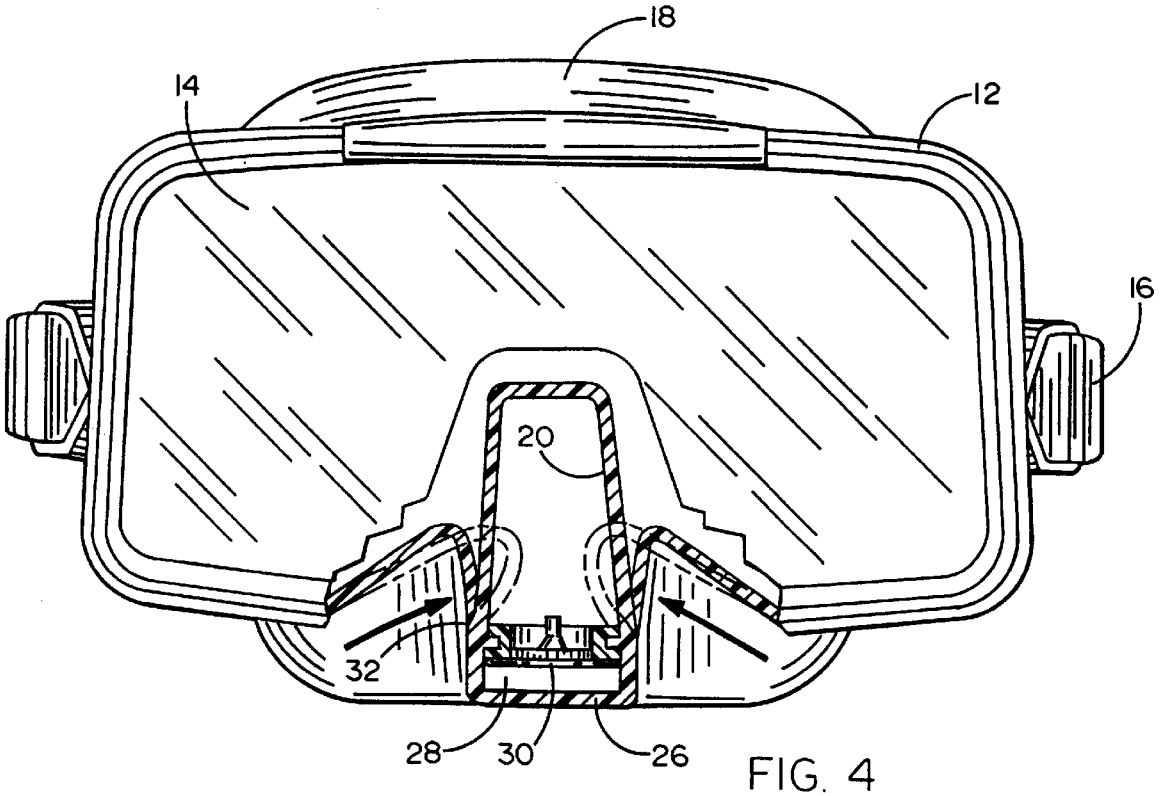
FIG. 4 is a partially cut-away front view of the first embodiment showing the purge valve and nose compression recesses.

Referring initially to FIGS. 1 through 4, it will be seen that a first embodiment 10 of the present invention comprises a frame 12, a window 14 and a soft skirt 18. The frame 12 provides a pair of strap receptacles 16 for receiving a strap (not shown) for securing the mask 10 to the face of a diver.

Skirt 18 is preferably molded of a cured silicone rubber-like clear or transparent material. However, any flexible, soft, water-tight rubber-like material, preferably transparent, would be suitable for use in skirt 18. The skirt is formed with a continuous edge 15 designed to be captured between the frame 12 and the window 14 upon assembly of the mask. Skirt 18 is shaped to provide a nose enclosure 20 terminating in a lower skirt member 24 through which there is a hole 25 in which there is secured a mushroom one-way valve 30 by press fit engagement. Immediately below the valve 30 is a channel wall 26 forming a channel 28. Channel 28 extends rearwardly and upwardly along the lower portion of the mask to route air bubbles to the respective sides of the mask where they cannot obscure the diver's vision. The face edge 19 of the skirt 18 acts in cooperation with a proximate seal member 21 to provide a secure water-tight seal when pressed against the diver's face. On each side of nose enclosure 20, there is a nose compression recess 32 in the skirt 18 which permits one-handed access to the sides of the diver's nose permitting closure of the nostrils for each pressure equalization. The mask 10 is a first embodiment of the invention characterized by side windows 22 and a unitary window 14.

Window 14 is preferably tempered glass. However, side windows 22 are merely large apertures in the sides of frame 12, but which are nevertheless water-tight by virtue of the soft skirt 18 which extends along the frame and, along with window 12, assures a secure seal against ambient water pressure.

Figure 5:
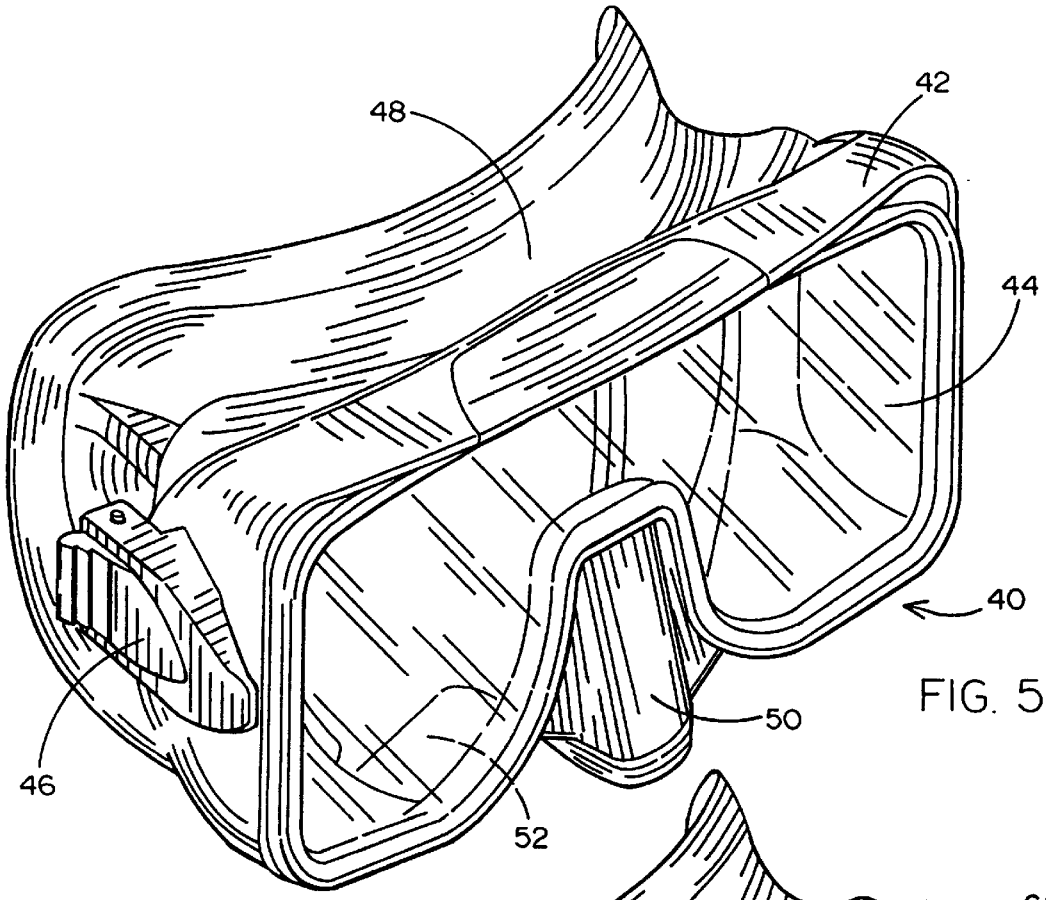
FIG. 5 is a three-dimensional view of a second embodiment of the invention.
Figure 6:
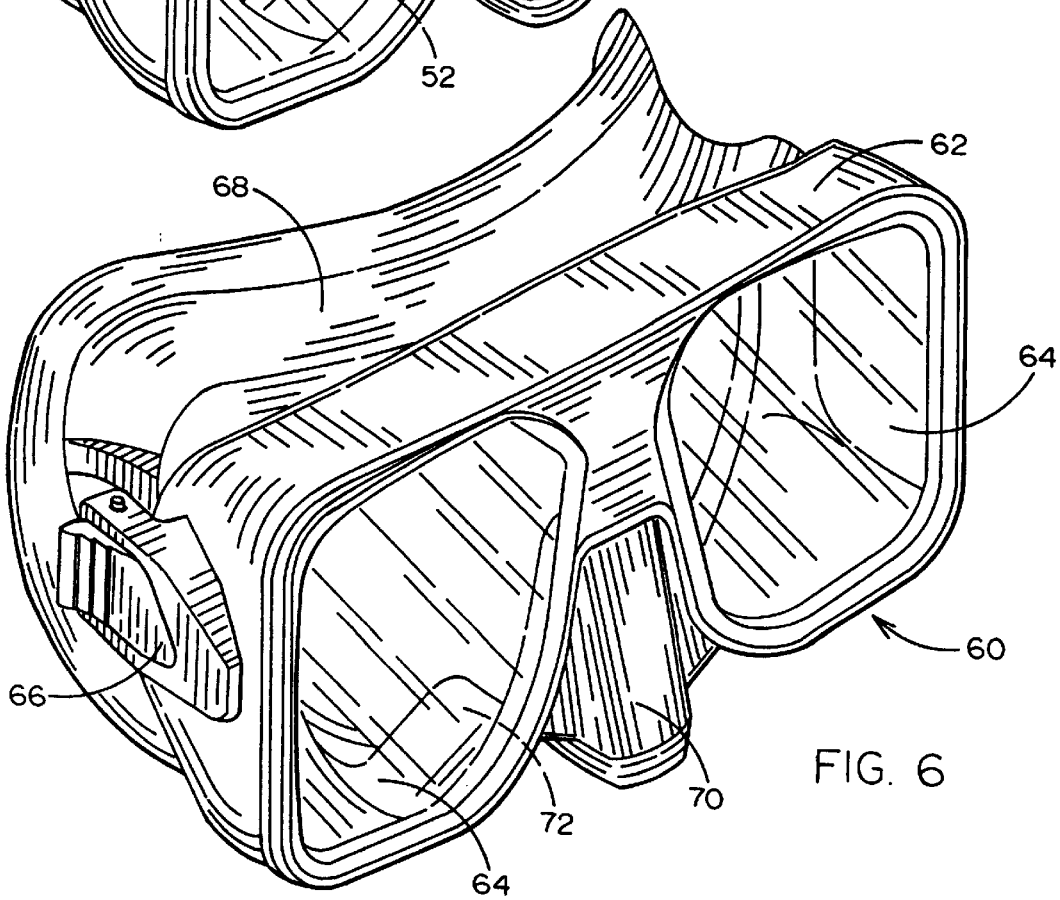
FIG. 6 is a three-dimensional view of a third embodiment of the invention.

The embodiments of FIGS. 5 and 6 differ from the embodiment of FIGS. 1–4 only in the shape of the frame and vision windows. The skirt is the same in all three embodiments, thus illustrating the advantageous design of the invention. More specifically, in the embodiment of FIG. 5, a mask 40 comprises a frame 42, a unitary window 44, strap receptacles 46 and a soft skirt 48, the latter having a nose enclosure 50 and a pair of nose compression recesses 52. The embodiment of FIG. 6 illustrates a mask 60 comprising a frame 62, a pair of small windows 64, a pair of strap receptacles 66 and a soft skirt 68, the latter having a nose enclosure 70 and a pair of nose compression recesses 72.

Having thus described preferred embodiments of the invention, which are only exemplary illustrations of the unique features thereof, what we claim as patentable subject matter comprises the following:

1. A dive mask comprising:

a frame having receptacles for receiving a strap for securing the mask to a diver's face; the frame having an opening for receiving a window;

a window in said frame opening; and a soft skirt secured between said window and said frame opening and extending rearwardly for sealing engagement with the diver's face;

said soft skirt having a nose enclosure and a nose compression recess on each side of said nose enclosure for permitting one-handed compression of the diver's nostrils, said soft skirt further comprising a purge valve at a lower end of said nose enclosure and a purge channel for directing air bubbles from said purge valve away from said window.

2. The dive mask recited in claim 1 wherein said soft skirt is made of a substantially transparent rubber-like material.

3. The dive mask recited in claim 2 wherein said material is silicone.

4. A dive mask comprising:

a frame having receptacles for receiving a strap for securing the mask to a diver's face; the frame having an opening for receiving a window;

a window in said frame opening;

a soft skirt secured between said window and said frame opening and extending rearwardly for sealing engagement with the diver's face;

said soft skirt having a nose enclosure and a purge valve at a lower end of said nose enclosure and a purge channel for directing air bubbles from said purge valve away from said window, said soft skirt further comprising a nose compression recess on each side of said nose enclosure for permitting one-handed compression of the diver's nostrils.

5. The dive mask recited in claim 4 wherein said soft skirt is made of a substantially transparent rubber-like material.

6. The dive mask recited in claim 5 wherein said material is silicone.

* * * * *